United States Patent [19]

Knowles

[11] 4,254,850

[45] Mar. 10, 1981

[54] LUGGAGE CASE

[76] Inventor: Harford E. Knowles, 2718 Jackson St., Hollywood, Fla. 33020

[21] Appl. No.: 88,875

[22] Filed: Oct. 29, 1979

[51] Int. Cl.[3] ..... A45C 5/14

[52] U.S. Cl. ..... 190/18 A; 280/645

[58] Field of Search ..... 190/18 A; 280/645, 37, 280/38, 47.26

[56] References Cited

U.S. PATENT DOCUMENTS

| | | | |
|---|---|---|---|
| 2,510,754 | 6/1950 | Norlin | 280/38 |
| 2,539,993 | 1/1951 | Davis | 280/645 |
| 3,141,680 | 7/1964 | McCord | 280/38 |
| 3,917,038 | 11/1975 | Foge | 190/18 A |

*Primary Examiner*—Donald F. Norton

*Attorney, Agent, or Firm*—Joseph Zallen

[57] ABSTRACT

Trunks and luggage having retractable wheels connected to a wheeling handle. The motion of each wheel is controlled by a cam slot so that the wheel moves out when the handle is extended but returns to storage position when the handle is retracted. Any required lost motion in extending the handle is provided by either an interlocking wire loop or a curved cam slot.

9 Claims, 10 Drawing Figures

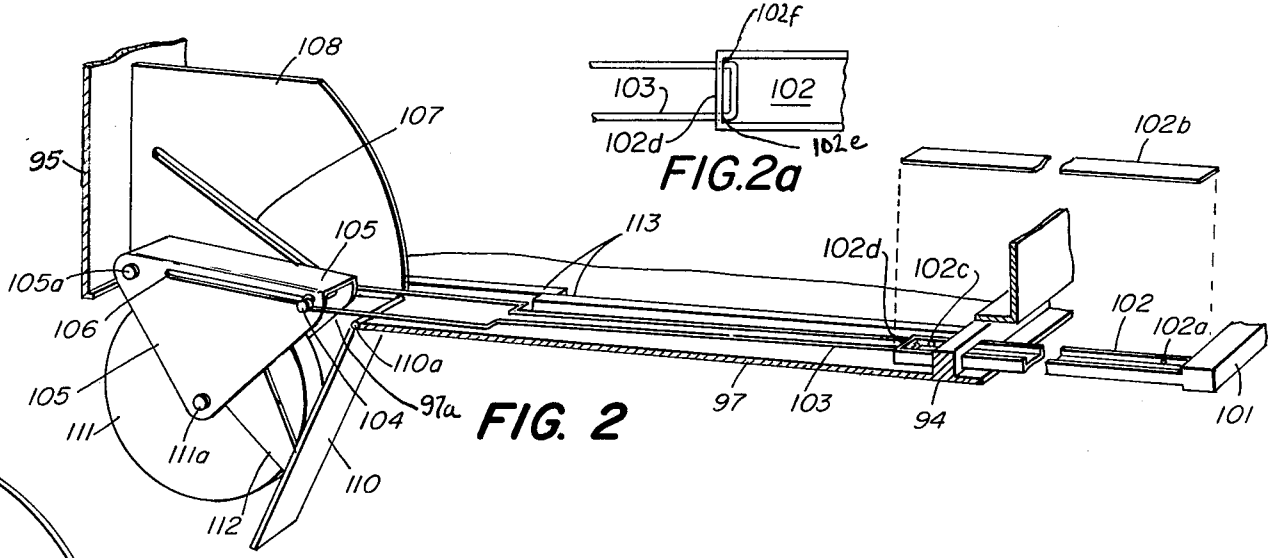
FIG. 2
FIG. 2a
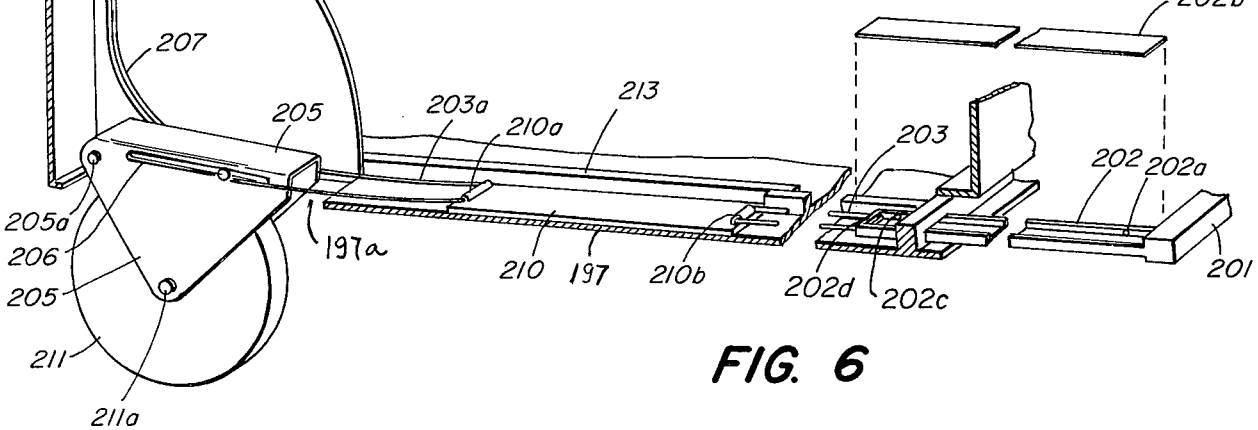
FIG. 6

LUGGAGE CASE

BACKGROUND OF INVENTION

This invention relates to luggage and in particular to trunks and luggage having retractable wheels.

The various mechanisms illustrated in the prior art are complex, difficult to maintain, expensive and occupy too much space.

One object of the present invention is to provide trunks and luggage having retractable wheels which are simpler to construct and operate than the prior art.

A further object of this invention is to provide such trunks and luggage which are more durable and require less maintenance.

Other objects and advantages of this invention will be apparent from the description and claims which follow taken together with the appended drawings.

SUMMARY OF INVENTION

The invention comprises generally a trunk or luggage case having a wheeling handle operatively connected to a pair of extensible wheels. The motion of each wheel is controlled by a cam slot so that the wheel moves out when the handle is extended but is arranged to return to storage position when the handle is retracted. A door is provided for each wheel to keep out the elements. The mechanism preferably comprises an elongated wire loop connected to a pivot pin which goes through the cam slot.

In one embodiment there is a sliding door which opens before the wheel is ejected. A curved cam slot provides any required lost motion in extending the handle.

In another embodiment the door is spring-loaded and opened by the ejection of the wheel. A stop is provided to hold the door open while the handle is extended. Any required lost motion in extending the handle is provided by having the handle legs engage a wheel wire loop after it has been substantially extended.

In a trunk or large case lost motion may not be needed, so that actuation of the handle operates directly on the wheel mechanisms.

BRIEF DESCRIPTION OF DRAWINGS

FIG. 2 is a view of the mechanism of the luggage case illustrated in FIG. 1 with the wheels and handle extended.

FIG. 2A is an enlarged plan view of a portion of FIG. 2.

FIG. 6 is a perspective view of the mechanism of the luggage case of FIG. 5 with the wheels and handle extended.

SPECIFIC EXAMPLES OF INVENTION

Figure 1:
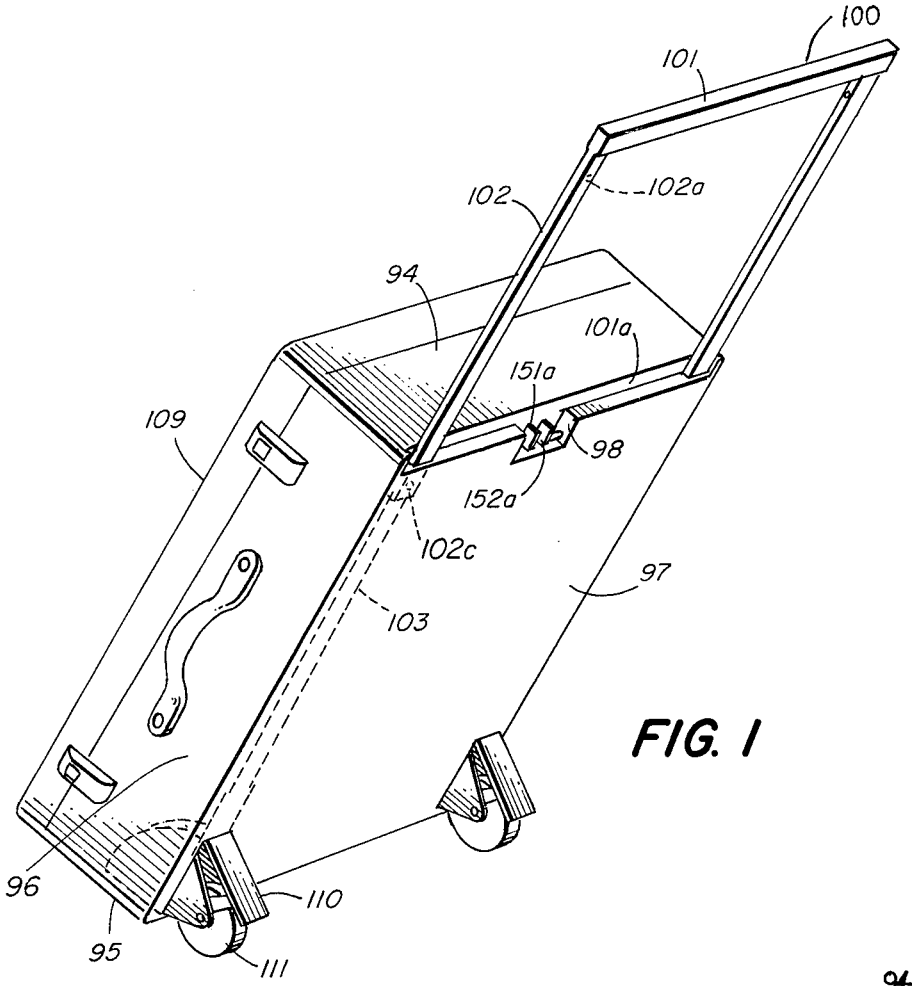
FIG. 1 is a perspective view of a luggage case made in accordance with this invention showing the handle and wheels extended, and having pivoting wheel doors.
Figure 1A:
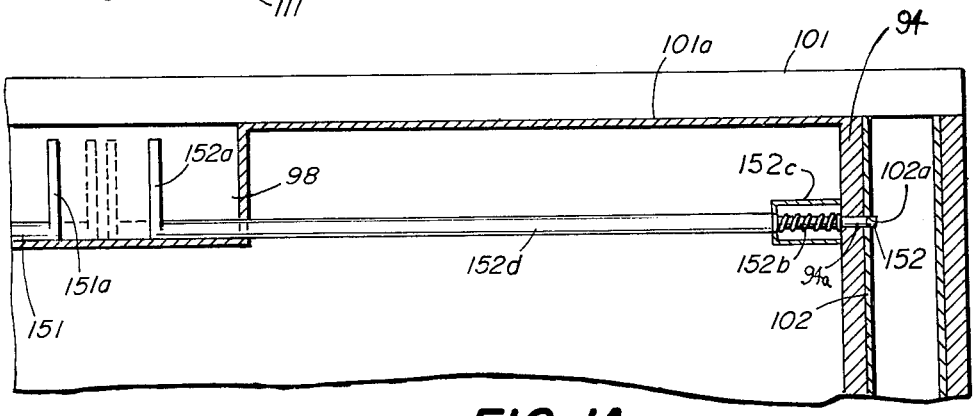
FIG. 1A is a partial section in the top portion of the case showing handle lock.
Figure 3:
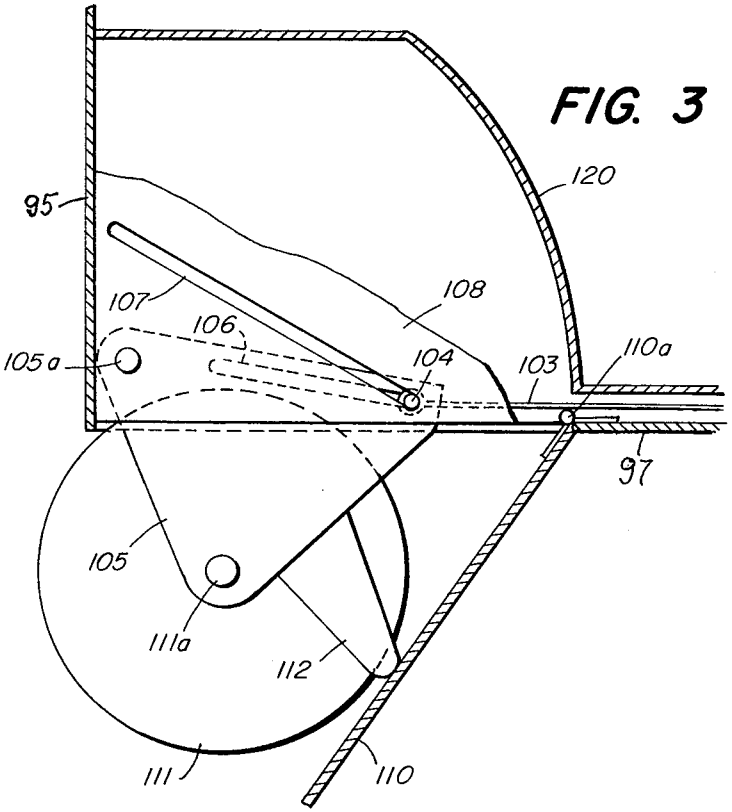
FIG. 3 is a schematic side view of the wheel portion in extended position.
Figure 4:
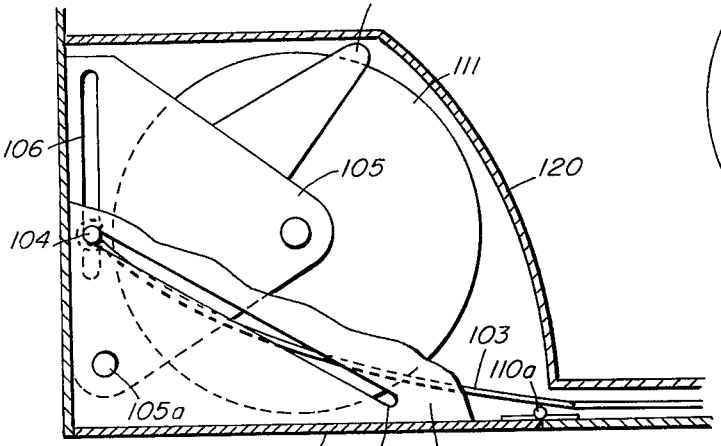
FIG. 4 is a schematic side view of the wheel in retracted position.

Referring now to FIGS. 1 to 4 there is illustrated therein a luggage case made in accordance with this invention. The wheeling handle 100 is U-shaped and comprises horizontal portion 101 storable in recess 101*a* and having at its ends a pair of vertical members 102. Vertical members 102 connect to the mechanisms for wheels 111, as explained below, so that when the wheeling handle 100 is fully extended the wheels 111 are extended, but when the horizontal portion 101 of wheeling handle 100 is stored in recess 101*a* the vertical members 102 are stored within the luggage case and the wheels 111 are retracted.

Locking means are provided to maintain the wheeling handle 100 in the selected extended or retracted position. The locking means comprise transverse locking rods 151 and 152 spaced adjacent recess 101*a* and having manipulable ends 151*a* and 152*a* in recess 98. Locking rods 151 and 152 are supported by tube 152*d* having at its end an enlarged spring housing 152*c* attached to the case wall and have springs 152*b* mounted near their ends. The springs 152*b* act in conjunction with the case wall 94 case wall orifice 94*a* and orifices 102*a* and 102*c* of vertical members 102. When handles 151*a* and 152*a* are pulled together the ends of rods 151 and 152 are pulled out of the orifices permitting vertical members 102 to move. The springs 152*b* maintain tension so that when the vertical members 102 are fully extended, the ends of the locking rods 151 and 152 engage the orifices 102*c* thus locking the handle in the extended position. Orifices 102*a* lock handle when retracted.

There is a separate mechanism for each wheel 111 connected and actuated by the common wheeling handle 100. The mechanism illustrated in FIG. 2 is similar for each wheel. The vertical member 102 comprises a U-shaped channel having cover plate 102*b* and transverse wall 102*d* having orifices or notches 102*e* and 102*f*. Closed wire loop 103 is movable through orifices 102*e* and 102*f* so that the outer portion of closed wire loop 103 acts as a lost motion upon extension of the handle. The combination of vertical member 102 and wire loop 103 move in a track 113. The ends of wire loop 103 are connected to both sides of a pin 104. Pin 104 slides in slot 106 of wheel holder 105 and also in the slot 107 of frame member 108. Frame member 108 is connected to wall 95 of the luggage case. Wheel support is pivotally supported by fixed pivot 105*a* mounted on luggage case frame member 108. Wheel support 105 also has a depending portion in which there is a pin 111*a* holding the wheel 111 and also a door stop portion 112. Door stop 112 acts against spring-pivoted door 110, which door forms a portion of wall 97 of the case in opening 97*a*.

Suitable cover plates 113*a* and 120 are provided to cover the track 113 so as to form a closed conduit for the motion of the mechanism.

The wire used in making wire 103 is preferably suitably tempered to maintain shape and yet have some flexibility. Where the mechanism illustrated in FIGS. 1 to 4 is applied to a trunk the wire 103 or handle can be shorter since no lost motion would be required.

Although this invention is not limited to any particular size, it is preferred that for common sizes of large luggage that wheels of two to four inches in diameter be used. For a three-inch wheel the enclosure for the embodiment illustrated in FIGS. 1 to 4 would be approximately four inches by three and a half inches. Rollers can be used in place of wheels, but wheels are preferred because of easier navigation particularly on rough surfaces.

Figure 5:
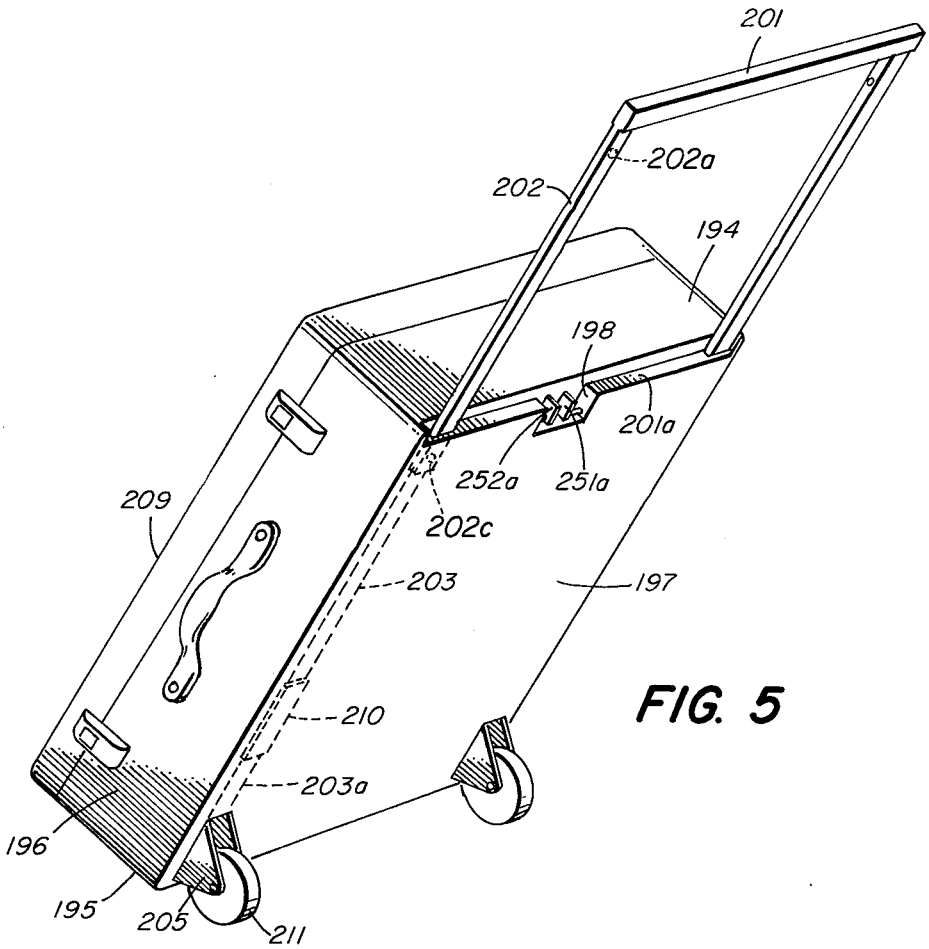
FIG. 5 is a perspective view of a second embodiment of this invention with the handle and wheels extended, having sliding rather than pivoting wheel doors.
Figure 7:
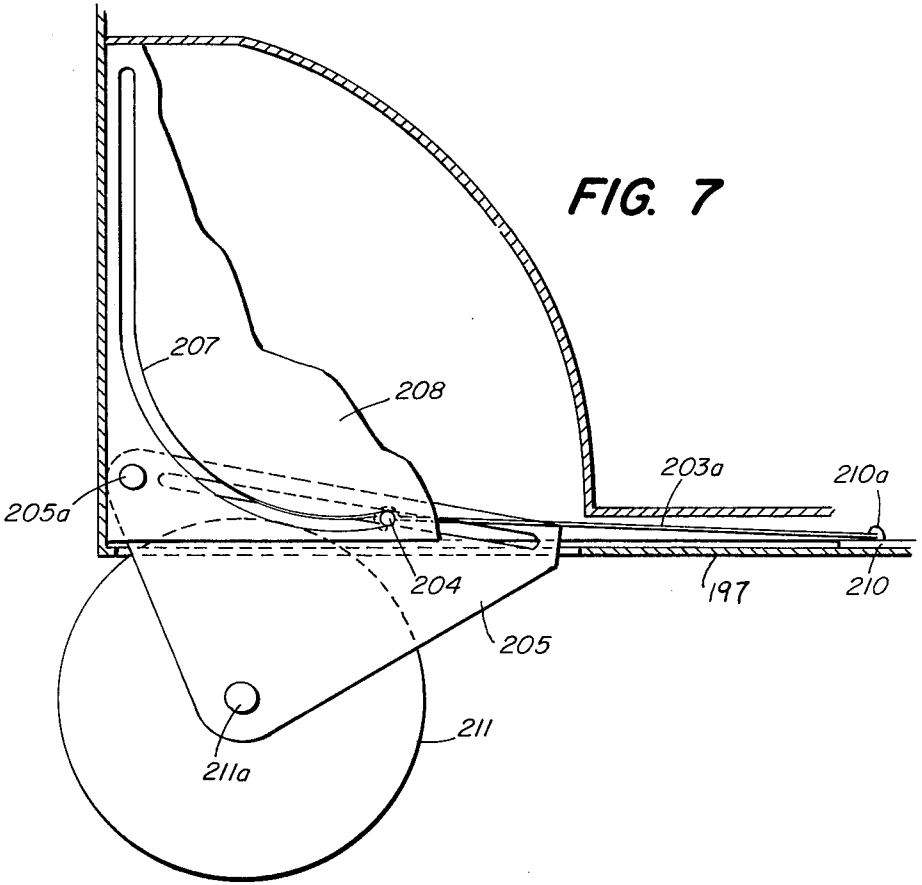
FIG. 7 is a side schematic view of the wheel portion of the luggage case of FIG. 5 with the wheels extended.
Figure 8:
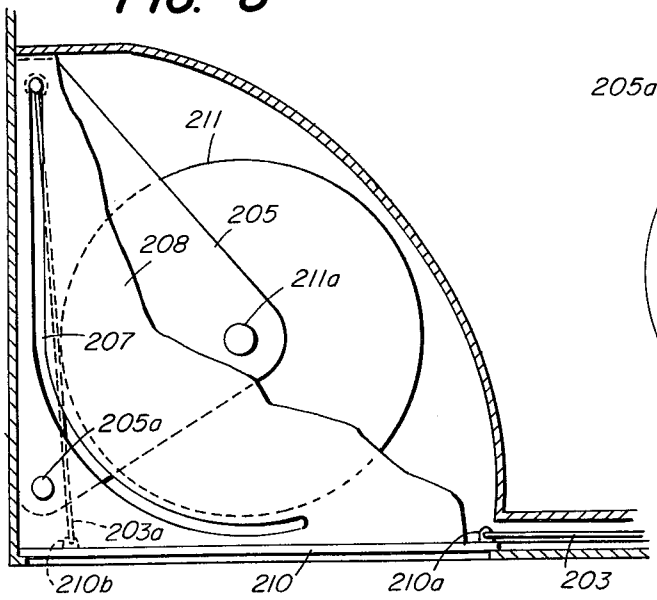
FIG. 8 is a side schematic view of the wheel portion of FIG. 5 with the wheels retracted.

Referring now to the embodiment illustrated in FIGS. 5–8 the mechanisms are housed in a similar manner as in the first embodiment and the handle and locking are similar. The significant difference between this second embodiment and the first embodiment is in the door and lost motion aspects. Instead of having a loop of wire provide all the lost motion with a swinging door, this second embodiment has a sliding door 210 in space 197*a* in wall 197 with the lost motion for same provided by the curvature of the cam slot 207 in frame member 208 which is connected to case wall 195. The wheeling handle 201 has a pair of U-shaped channels 202 sliding within track 213 and interlocked at wall 202*d* to wire loop 203. The other end of loop 203 is permanently connected to one end of the sliding door 210. Door 210 moves in track 213 and at its other end is permanently connected by wire loop 203*a* to pin 204. Pin 204 extends through straight slot 206 of wheel support 205 and also through curved slot 207 of frame member 208. Wheel 211 is suspended on the lower portions of wheel holder 205 by pin 211*a*. Wheel support 205 is permanently connected by fixed pivot 205*a* to frame member 208. Cover plates 213*b* and 213*c* are provided to form an enclosed conduit with the tracks 213 and 213*a*.

In the claims which follow, it is intended that the word "slot" be used in its generic sense to also include "groove."

I claim:

1. In a luggage case wherein there is the combination of an opening in a wall thereof, door means registerable with said opening, wheel means stored in said case adjacent said opening, operating means for simultaneously extending and retracting said wheel means and opening and closing said door means, and handle means for actuating said operating means, the improvement in which:

(a) the wheel means comprises a wheel (111) mounted on a wheel support member which is pivotally supported by said luggage case and has a first slot (106); and (b) the operating means comprises a second slot (107) adjacent said first slot, slot engaging means (104) extending through both said slots, and connection means (103) connected to said slot engaging means (104) and to said handle means.

2. The luggage case of claim 1, in which there are two such combinations and the handle means are joined together.

3. The luggage case of claim 2 wherein the handle includes a transverse portion storable in a recess in the luggage case and has manipulable locking means for locking the wheels in extended or retracted position.

4. The luggage case of claim 1 wherein each said slot is in a straight line.

5. The luggage case of claim 1 wherein said second slot (207) is curved.

6. The luggage case of claim 1 wherein the door (110) is pivotable and spring-loaded.

7. The luggage case of claim 1 wherein the door (210) is slidable and is part of said connection means.

8. The luggage case of claim 1 wherein said connection means comprises a wire loop (103) attached to the handle means and to said slot-engaging means (104).

9. The luggage case of claim 1 wherein the door (110) is pivotable and spring loaded and said connection means comprises a wire loop (103) attached to said slot-engaging means and interlockingly movable in said handle means (101) so as to provide lost motion.

* * * * *